US009146077B2

(12) United States Patent
Moore et al.

(10) Patent No.: US 9,146,077 B2
(45) **Date of Patent: *Sep. 29, 2015**

(54) SHOTGUN WITH SIGHTING DEVICE

(71) Applicants: Larry E. Moore, Cottonwood, AZ (US); Aaron Moore, Cottonwood, AZ (US)

(72) Inventors: Larry E. Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/316,688

(22) Filed: Jun. 26, 2014

(65) Prior Publication Data

US 2014/0305023 A1 Oct. 16, 2014

Related U.S. Application Data

(63) Continuation of application No. 13/707,312, filed on Dec. 6, 2012, now Pat. No. 8,844,189.

(51) Int. Cl.

| | |
|---|---|
| ***F41G 1/34*** | (2006.01) |
| ***F41G 1/36*** | (2006.01) |
| ***F41G 1/00*** | (2006.01) |
| ***F41G 1/35*** | (2006.01) |
| ***F41A 33/02*** | (2006.01) |

(52) U.S. Cl.

CPC . *F41G 1/36* (2013.01); *F41A 33/02* (2013.01); *F41G 1/00* (2013.01); *F41G 1/34* (2013.01); *F41G 1/35* (2013.01)

(58) Field of Classification Search

CPC ..... F41G 1/32; F41G 1/34; F41G 1/345; F41G 1/35; F41G 1/36; F41G 1/00; F41A 33/02

USPC ..... 42/114, 115, 117, 146; 361/11; 362/259

See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,904,888 | A | 9/1959 | Niesp |

(Continued)

FOREIGN PATENT DOCUMENTS

| | | |
|---|---|---|
| BE | 1009564 | 5/1997 |
| EP | 1046877 | 10/2000 |

OTHER PUBLICATIONS

EPO; Office Action dated Oct. 5. 2011 in Serial No. 09169459.

(Continued)

*Primary Examiner* — Stephen M Johnson
(74) *Attorney, Agent, or Firm* — Snell & Wilmer LLP

(57) ABSTRACT

A sighting device replicates the spread pattern of pellets exiting the barrel of a shotgun. The sighting device includes a light source (preferably a laser) and a power source connectable to the light source. The device may also include a mount to attach the sighting device to a shotgun. The sighting device preferably projects a circular pattern of individual light beams wherein the circumference of the circular pattern increases as the light beams move farther from the sighting device to replicate the spread of shotgun pellets. The sighting device may also project a beam of light in the center of the pattern.

25 Claims, 13 Drawing Sheets

(56) References Cited

U.S. PATENT DOCUMENTS 3,112,567 A 12/1963 Flanagan
3,192,915 A 7/1965 Norris et al.
3,284,905 A 11/1966 Simmons
3,510,965 A 5/1970 Rhea
3,526,972 A 9/1970 Sumpf
3,573,868 A 4/1971 Giannetti
3,641,676 A 2/1972 Knutsen et al.
3,645,635 A 2/1972 Steck
3,801,205 A 4/1974 Eggenschwyler
3,914,873 A 10/1975 Elliott, Jr. et al.
3,992,783 A 11/1976 Dunlap et al.
3,995,376 A 12/1976 Kimble et al.
4,026,054 A * 5/1977 Snyder ..... 42/115
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,352,665 A 10/1982 Kimble et al.
4,481,561 A 11/1984 Lanning
4,488,369 A 12/1984 Van Note
4,541,191 A 9/1985 Morris et al.
4,567,810 A 2/1986 Preston
4,713,889 A 12/1987 Santiago
4,763,431 A 8/1988 Allan et al.
4,825,258 A 4/1989 Whitson
4,830,617 A 5/1989 Hancox et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,967,133 A 10/1999 Gardner
5,983,774 A 11/1999 Mihaita
5,992,030 A * 11/1999 Mann ..... 42/144
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,345,464 B1 2/2002 Kim et al.
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 6/2003 Shechter
6,591,536 B2 7/2003 Houde-Walter et al.

(56) References Cited

U.S. PATENT DOCUMENTS 6,606,797 B1 8/2003 Gandy
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,782,789 B2 8/2004 McNulty
6,854,205 B2 2/2005 Wikle et al.
6,931,775 B2 8/2005 Burnett
6,935,864 B2 8/2005 Shechter et al.
6,966,775 B1 11/2005 Kendir et al.
7,032,342 B2 4/2006 Pikielny
7,049,575 B2 5/2006 Hotelling
7,111,424 B1 9/2006 Moody et al.
7,121,034 B2 10/2006 Keng
7,134,234 B1 11/2006 Makarounis
7,191,557 B2 3/2007 Gablowski et al.
D542,446 S 5/2007 DiCarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
RE40,429 E 7/2008 Oliver et al.
D578,599 S 10/2008 Cheng
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,578,089 B1 8/2009 Griffin
7,584,569 B2 9/2009 Kallio et al.
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,104,220 B2 1/2012 Cobb
D653,798 S 2/2012 Janice et al.
8,109,024 B2 2/2012 Abst
8,110,760 B2 2/2012 Sharrah et al.
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,151,504 B1 4/2012 Aiston
8,151,505 B2 4/2012 Thompson
8,166,694 B2 5/2012 Swan
8,172,139 B1 5/2012 McDonald et al.
D661,366 S 6/2012 Zusman
8,196,328 B2 6/2012 Simpkins
8,215,047 B2 7/2012 Ash et al.
8,225,542 B2 7/2012 Houde-Walter
8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
D697,162 S 1/2014 Faifer
8,661,725 B1 3/2014 Ganther et al.

(56) References Cited

U.S. PATENT DOCUMENTS

| | | | | |
|---|---|---|---|---|
| 8,734,156 | B2 | 5/2014 | Uhr | |
| 8,739,447 | B2 | 6/2014 | Merritt et al. | |
| 8,844,189 | B2 * | 9/2014 | Moore et al. | 42/115 |
| 8,919,023 | B2 | 12/2014 | Merritt et al. | |
| 8,938,904 | B1 | 1/2015 | Sellers et al. | |
| 8,944,838 | B2 | 2/2015 | Mulfinger | |
| 2001/0042335 | A1 | 11/2001 | Strand | |
| 2002/0009694 | A1 | 1/2002 | Rosa | |
| 2002/0051953 | A1 | 5/2002 | Clark et al. | |
| 2002/0057719 | A1 | 5/2002 | Shechter | |
| 2002/0073561 | A1 | 6/2002 | Liao | |
| 2002/0129536 | A1 | 9/2002 | Iafrate et al. | |
| 2002/0134000 | A1 | 9/2002 | Varshneya et al. | |
| 2002/0194767 | A1 | 12/2002 | Houde Walter et al. | |
| 2003/0003424 | A1 | 1/2003 | Shechter et al. | |
| 2003/0029072 | A1 | 2/2003 | Danielson et al. | |
| 2003/0175661 | A1 | 9/2003 | Shechter et al. | |
| 2003/0180692 | A1 | 9/2003 | Skala et al. | |
| 2003/0196366 | A1 | 10/2003 | Beretta | |
| 2004/0003529 | A1 | 1/2004 | Danielson | |
| 2004/0010956 | A1 | 1/2004 | Bubits | |
| 2004/0014010 | A1 | 1/2004 | Swensen et al. | |
| 2005/0044736 | A1 | 3/2005 | Liao | |
| 2005/0153262 | A1 | 7/2005 | Kendir | |
| 2005/0185403 | A1 | 8/2005 | Diehl | |
| 2005/0188588 | A1 | 9/2005 | Keng | |
| 2005/0241209 | A1 | 11/2005 | Staley | |
| 2005/0257415 | A1 | 11/2005 | Solinsky et al. | |
| 2005/0268519 | A1 | 12/2005 | Pikielny | |
| 2006/0162225 | A1 | 7/2006 | Danielson | |
| 2006/0191183 | A1 | 8/2006 | Griffin | |
| 2007/0039226 | A1 | 2/2007 | Stokes | |
| 2007/0041418 | A1 | 2/2007 | Laughman et al. | |
| 2007/0056203 | A1 | 3/2007 | Gering et al. | |
| 2007/0113460 | A1 * | 5/2007 | Potterfield et al. | 42/120 |
| 2007/0190495 | A1 | 8/2007 | Kendir et al. | |
| 2007/0258236 | A1 | 11/2007 | Miller | |
| 2007/0271832 | A1 | 11/2007 | Griffin | |
| 2008/0000133 | A1 | 1/2008 | Solinsky et al. | |
| 2008/0060248 | A1 | 3/2008 | Pine et al. | |
| 2008/0134562 | A1 | 6/2008 | Teetzel | |
| 2009/0013580 | A1 | 1/2009 | Houde-Walter | |
| 2009/0013581 | A1 | 1/2009 | LoRocco | |
| 2009/0178325 | A1 | 7/2009 | Veilleux | |
| 2009/0183416 | A1 | 7/2009 | Danielson | |
| 2009/0293335 | A1 | 12/2009 | Danielson | |
| 2009/0293855 | A1 | 12/2009 | Danielson | |
| 2010/0058640 | A1 | 3/2010 | Moore et al. | |
| 2010/0162610 | A1 | 7/2010 | Moore et al. | |
| 2010/0175297 | A1 | 7/2010 | Speroni | |
| 2010/0229448 | A1 | 9/2010 | Houde-Walter | |
| 2010/0275496 | A1 | 11/2010 | Solinsky et al. | |
| 2011/0047850 | A1 | 3/2011 | Rievley et al. | |
| 2011/0061283 | A1 | 3/2011 | Cavallo | |
| 2011/0162249 | A1 | 7/2011 | Woodmansee et al. | |
| 2011/0185619 | A1 | 8/2011 | Finnegan et al. | |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2013/0185982 | A1 | 7/2013 | Hilbourne et al. | |
| 2013/0263492 | A1 | 10/2013 | Erdle | |
| 2014/0109457 | A1 | 4/2014 | Speroni | |

OTHER PUBLICATIONS

EPO; Office Action dated Oct. 5, 2011 in Serial No. 09169469.
EPO; Office Action dated Dec. 20, 2011 in Application No. 09169476.
EPO; Office Action dated Sep. 3, 2012 in Application No. 09169469.
EPO; Office Action dated Sep. 3, 2012 in Application No. 09169476.
EPO; Office Action dated Sep. 3, 2012 in Application No. 09169459.
EPO; Search Opinion and Report dated Aug. 6, 2010 in Serial No. 09169459.
EPO; Search Opinion and Report dated Aug. 6, 2010 in Serial No. 0969469.
EPO; Search Opinion and Report dated Aug. 23, 2010 in Serial No. 09169476.
EPO; Search Report and Opinion dated Aug. 6, 2012 in Serial No. 11151504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.

(56) References Cited

OTHER PUBLICATIONS

USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.
USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Office Action dated Mar. 3, 2015 in U.S. Appl. No. 14/278,315.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.

* cited by examiner

SHOTGUN WITH SIGHTING DEVICE

CROSS-REFERENCE TO RELATED APPLICATIONS

This application is a continuation of and claims priority to U.S. patent application Ser. No. 13/707,312, now U.S. Pat. No. 8,844,189 entitled SIGHTING DEVICE REPLICATING SHOTGUN PATTERN SPREAD, filed on Dec. 6, 2012, the disclosure of which is incorporated herein by reference.

FIELD OF THE INVENTION

The present invention relates to a light-emitting sighting device, particularly a laser, that can be mounted on a shotgun and that emits a pattern that replicates the spreading pattern of shotgun pellets after being fired. The disclosures of U.S. Pat. No. 8,127,485 to Moore et al. and U.S. application Ser. No. 12/160,213 to Moore et al. are incorporated herein by reference.

BACKGROUND OF THE INVENTION

It is known to utilize a light beam, such as a laser beam, as a sighting aid for guns. Lasers are the preferred means of generating light beams for weapon sighting because they have comparatively high intensity and can be focused into a narrow beam with a very small divergence angle so they produce a small, bright spot on a target. If mounted properly on a gun, the laser projects a beam of laser light in a direction generally parallel to the gun's bore. When the light beam and bore are properly aligned, the bullet (or other projectile) will strike, or strike very close to, the location of the light beam projected on a target. Such laser sighting devices can be used to target a weapon when using live ammunition or to simulate the actual firing of a weapon whereby the laser beam strikes a target to show where a live round would land.

It was known to use a laser connected to a gun to generate a pattern of light, such as a circular pattern formed by multiple laser light beams with a single laser light beam in the center. The problem with this device is that the light beams were projected outward its an exaggerated angle. Thus, the device may have been useful for centering and aiming a gun firing a bullet, but did not replicate the spread pattern of shotgun pellets after being fired. Thus, such a device did not accurately frame a target with respect to where shotgun pellets would land. This was especially true the farther the target was from the device, since the farther away the target, the greater the shotgun pellet spread.

SUMMARY OF THE INVENTION

The invention is a sighting device for a shotgun (hereafter, sometimes referred to as "sighting device" or "device"), or for a structure replicating a shotgun. A shotgun and device replicating a shotgun, which might be used for laser beam target practice are collectively referred to herein as "shotgun." The sighting device includes a light source, which is most preferably a laser. The sighting device may be mounted on or included as part of a shotgun and can be used to aim the shotgun before firing a live round of ammunition, or to simulate the actual firing of a shotgun by the light emanating from the light source showing the area in which pellets from a live shotgun round would land. Once activated, light beams from the sighting device are projected outwardly, preferably in a circular pattern, that expands as the light beams travel farther from the sighting device, thereby replicating the spread pattern of pellets fired from a shotgun. The sighting device preferably includes a laser as the light source, a power source connectable to the laser, and a mount for mounting the sight to the shotgun. In one embodiment, the sighting device is attached to a picatinny rail of the shotgun, although it can be attached to or included as part of a shotgun in any suitable manner.

DETAILED DESCRIPTION OF PREFERRED EMBODIMENTS

Figure 1:
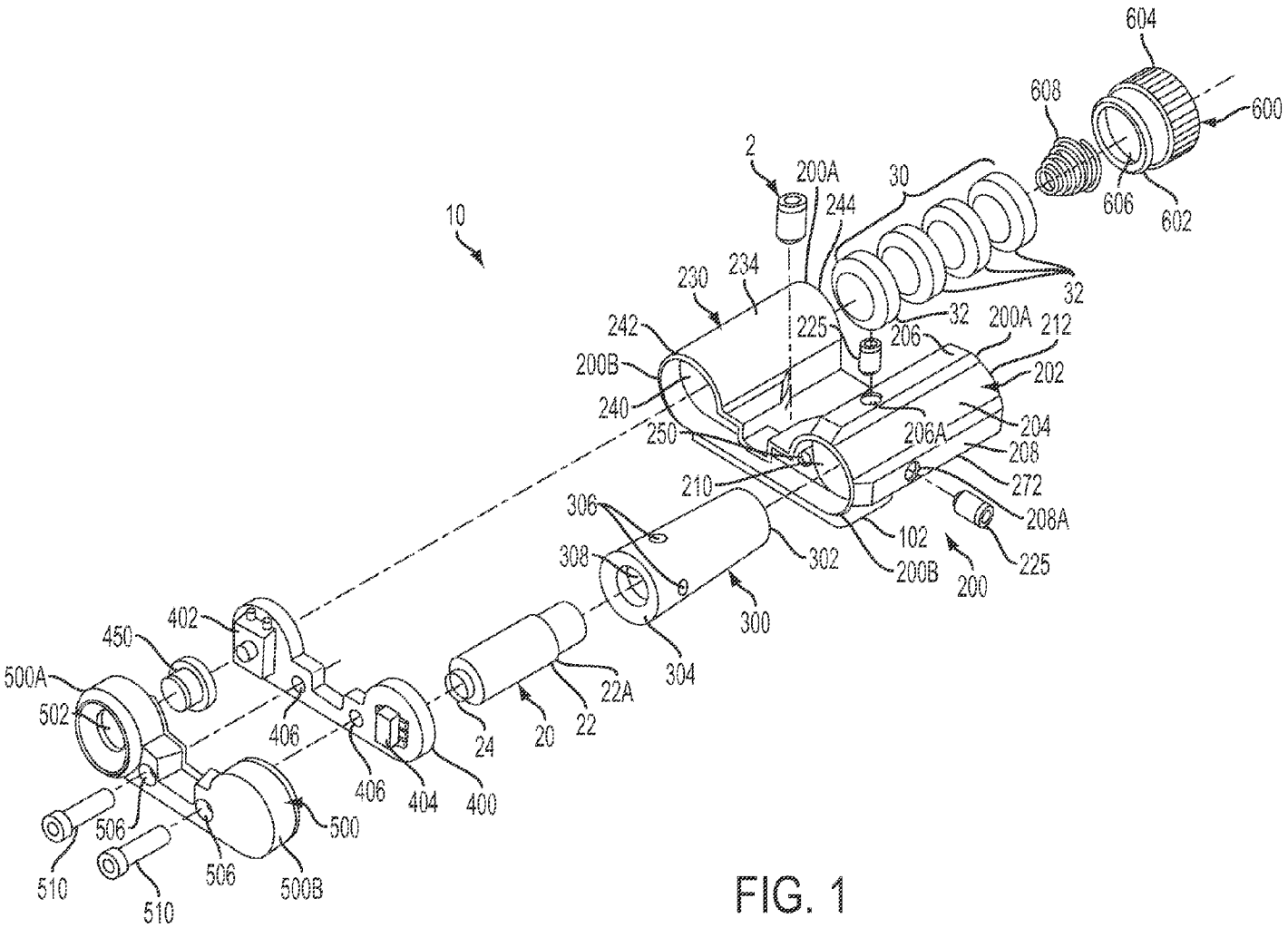
FIG. 1 is an exploded view of an embodiment of the present invention.
Figure 1A:
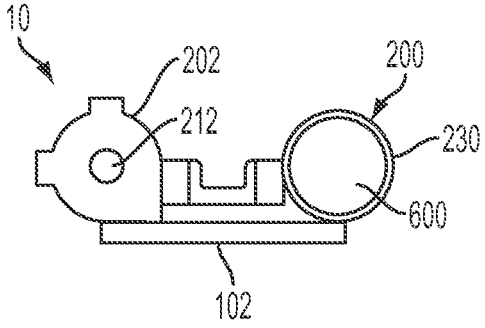
FIG. 1A is a front view of the assembled device shown in FIG. 1.
Figure 1B:
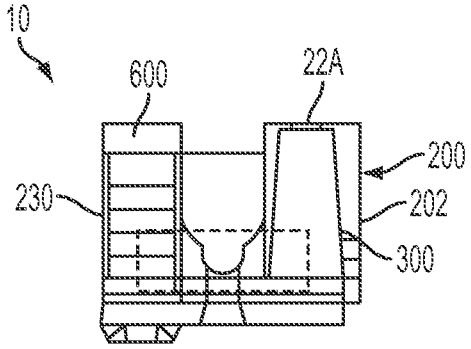
FIG. 1B is a top view of the device shown in FIGS. 1 and 1A.
Figure 1C:
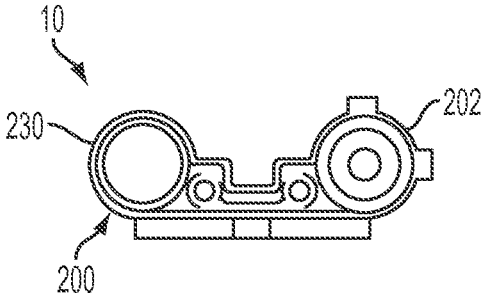
FIG. 1C is a rear view of the device shown in FIGS. 1-1B but without the backing or the button yet attached.
Figure 1D:
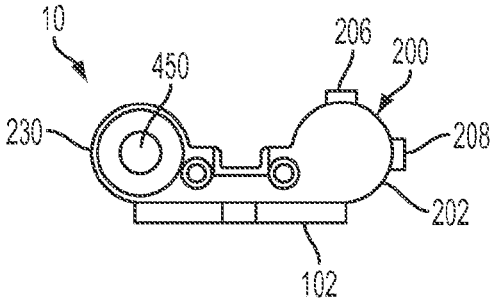
FIG. 1D is a rear view of the device shown in FIGS. 1-1C when fully assembled.
Figure 1E:
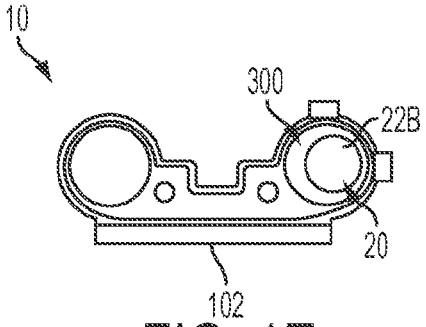
FIG. 1E is a rear view of the device shown in FIGS. 1-1D without the backing or the integrated circuit board and showing the laser module biased to one side (the laser biasing spring also is not shown).
Figure 1F:
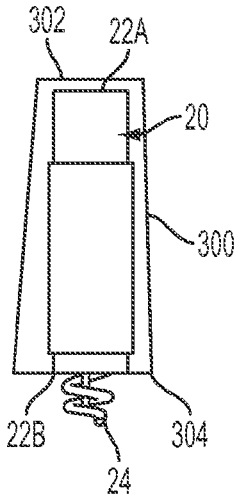
FIG. 1F is a partial, cross-sectional top view of a light source biased to one side of the biasing cone (or light source adjustment apparatus).
Figure 2:
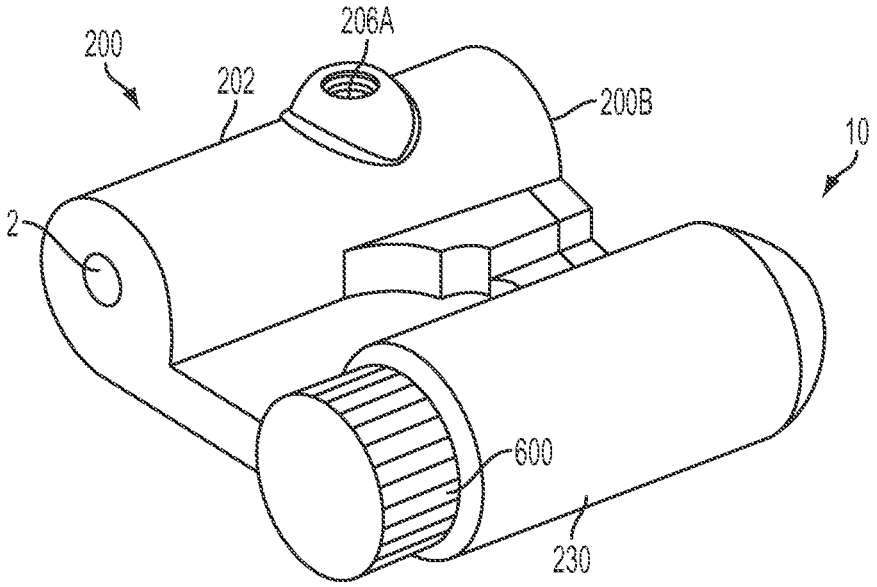
FIG. 2 is a side, perspective view showing the embodiment of FIG. 1.
Figure 3:
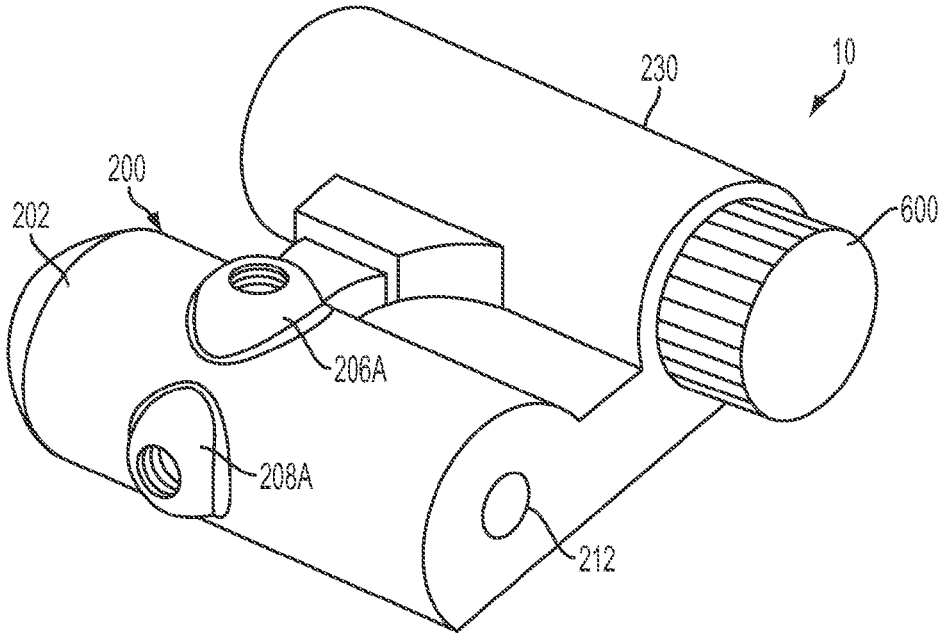
FIG. 3 is an alternate side, perspective view of the embodiment shown in FIGS. 1 and 2.
Figure 4:
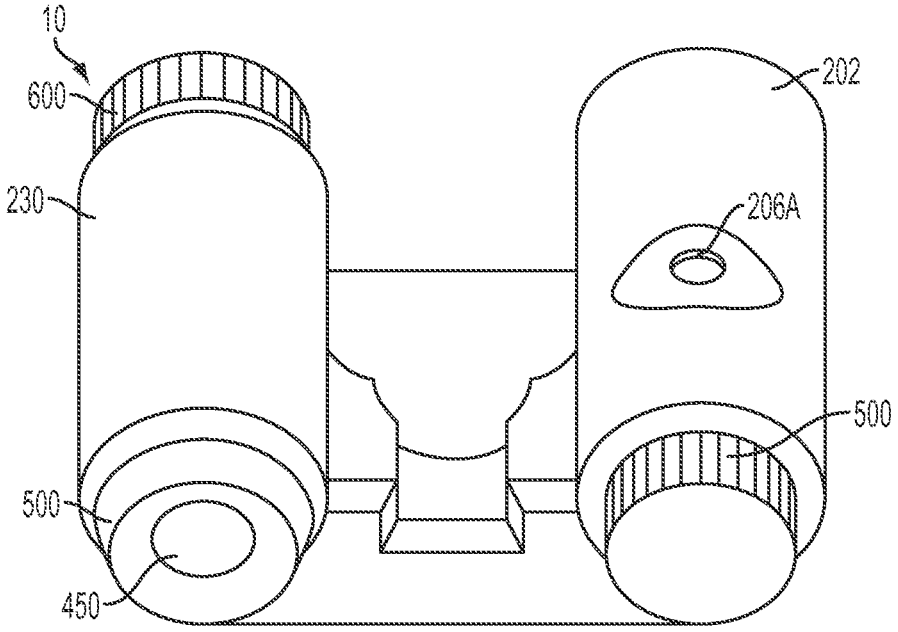
FIG. 4 is a rear, top, perspective view of the embodiment shown in FIGS. 1-3.
Figure 5:
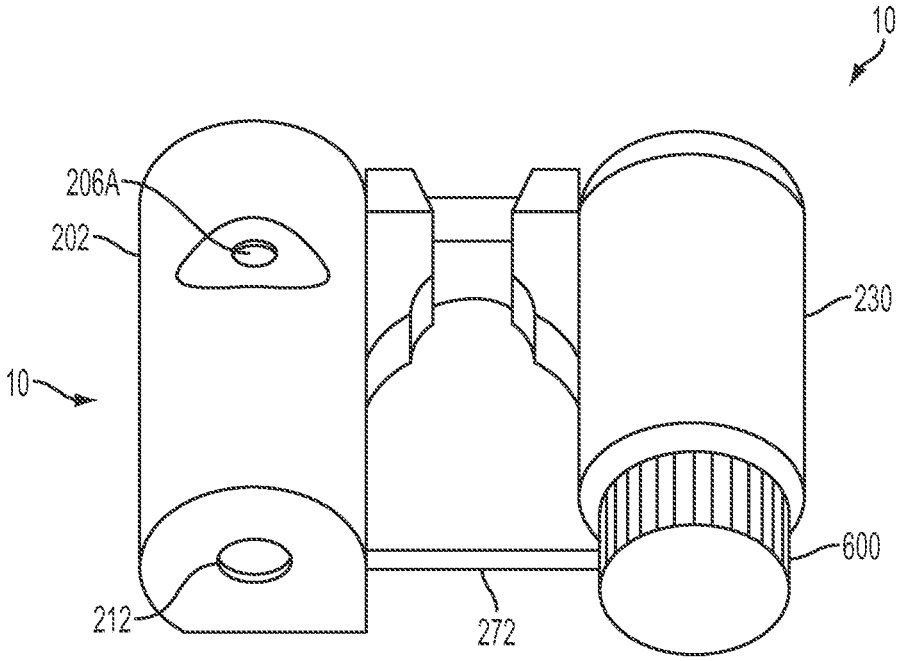
FIG. 5 is a front, top, perspective view of the embodiment shown in FIGS. 1-4.
Figure 6:
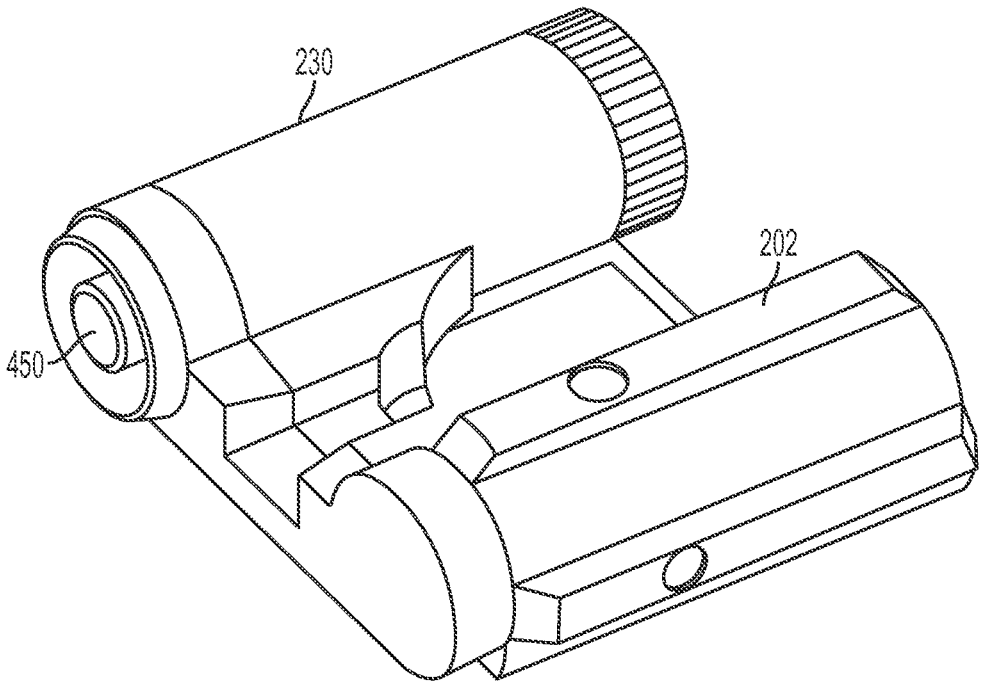
FIG. 6 is a rear, perspective view of a device according to the invention.

Turning now to the drawings where the purpose is to describe a preferred embodiment of the invention and not to limit same, FIGS. 1-7 show a preferred embodiment of a sighting device 10 according to the invention. Device 10 as shown is a laser sight, but could be any structure that includes a light source and one or more power sources connectable to the light source and that can simulate the spread pattern of shotgun pellets exiting the barrel of a shotgun.

Preferably, device 10 is configured to be mounted on a shotgun 11, and most preferably on a picatinny rail of the shotgun 11. A picatinny rail 9 (best seen in FIG. 7) is known in the art and used to connect accessories to gun. As shown, picatinny rail 9 is on the top of the shotgun barrel.

Device 10 could also be mounted to or formed in the shotgun in any other suitable, fashion that allows the light source of device 10 to be accurately projected along the longitudinal axis of the shotgun barrel 13, and/or along the longitudinal axis of a light source 20.

Device 10 includes a light source 20, a power source 30 and a housing 200 that includes a mount 102, which as shown has a first leg and a second leg, which are not shown here, but preferably have the same structures as legs 1002A and 1002B discussed below, that fit onto picatinny rail 9.

Light source 20 has a first end 20A (through which light can be emitted), is preferably a visible-light laser module, but could be any light source, including a light emitting diode ("LED") flashlight (as used herein "flashlight" means any source of visible light other than a laser) or an infra-red light source (such as an infra-red LED or infra-red laser). In the embodiment shown light source 20 is a red-light, 650 nanometer, 3.3 mm diode, visible laser, and the laser module has an overall length of about 14 mm and a diameter of about 4.5 mm. Any suitable laser/laser module may be used, however. A biasing spring 24 is attached to second end 20B to bias light source 20 towards first end 20A when device 10 is assembled. Light source 20 includes a diffraction lens (not shown) that converts the single laser beam generated by light source 20 into multiple, individual beams of light. Diffraction lenses are known to those skilled in the art. In embodiments of the present invention, the diffraction lens can be assembled as part of light source 20 or be positioned outside of light source 20.

The multiple light beams generated by the diffraction lens are spread apart so as to define an area between them. The area can be of any suitable shape for replicating the area in which pellets exiting a shotgun would occupy. It is most preferable that the area defined by the multiple light beams is circular, but it could also be triangular, oval, rectangular, hexagonal, octagonal or of any suitable shape. In one preferred embodiment there are at least three light beams defining the area, and most preferably eight beams of light defining the area, even though any number of light beams of three or more can be utilized. Additionally, a complete, uninterrupted pattern of light could be created to form an area between the pattern.

Figure 7:
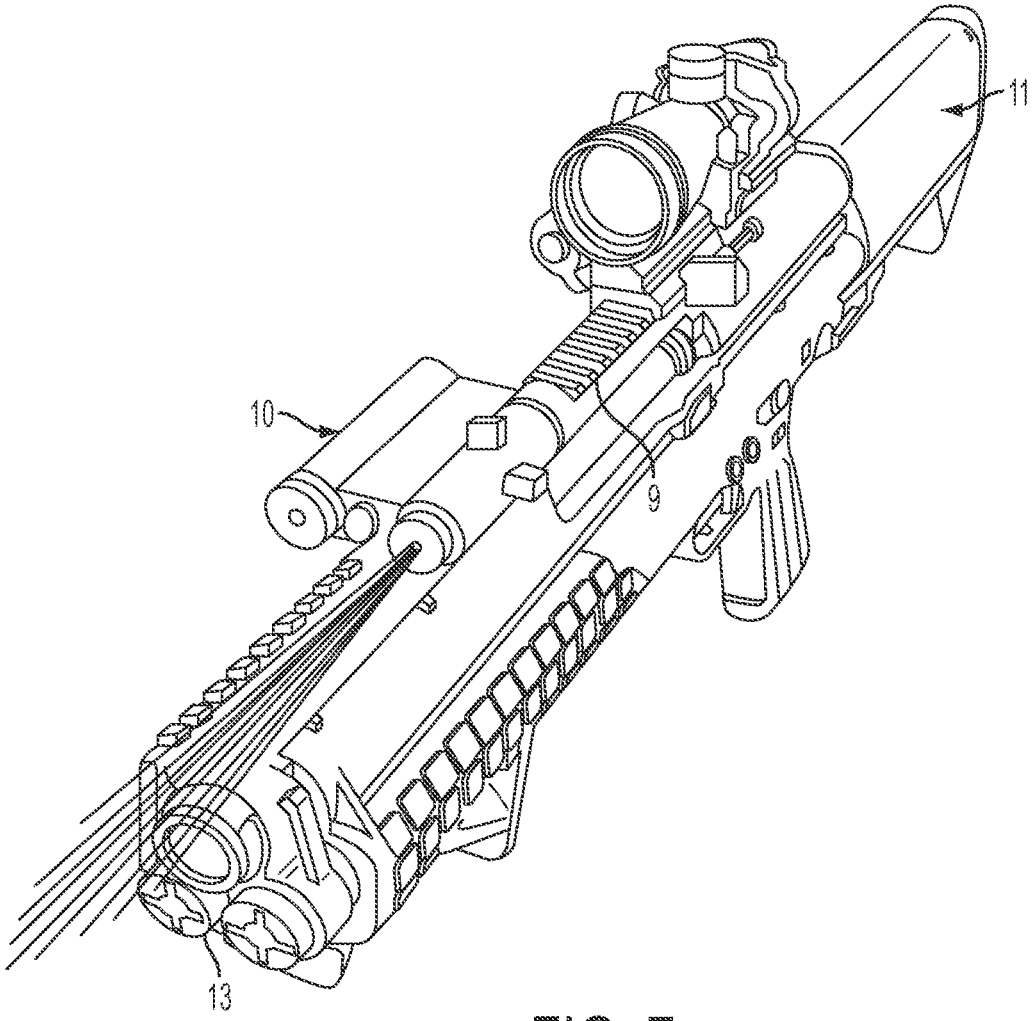
FIG. 7 shows an embodiment of a sighting device according to the invention that is mounted to the picatinny rail of a shotgun.
Figure 8:
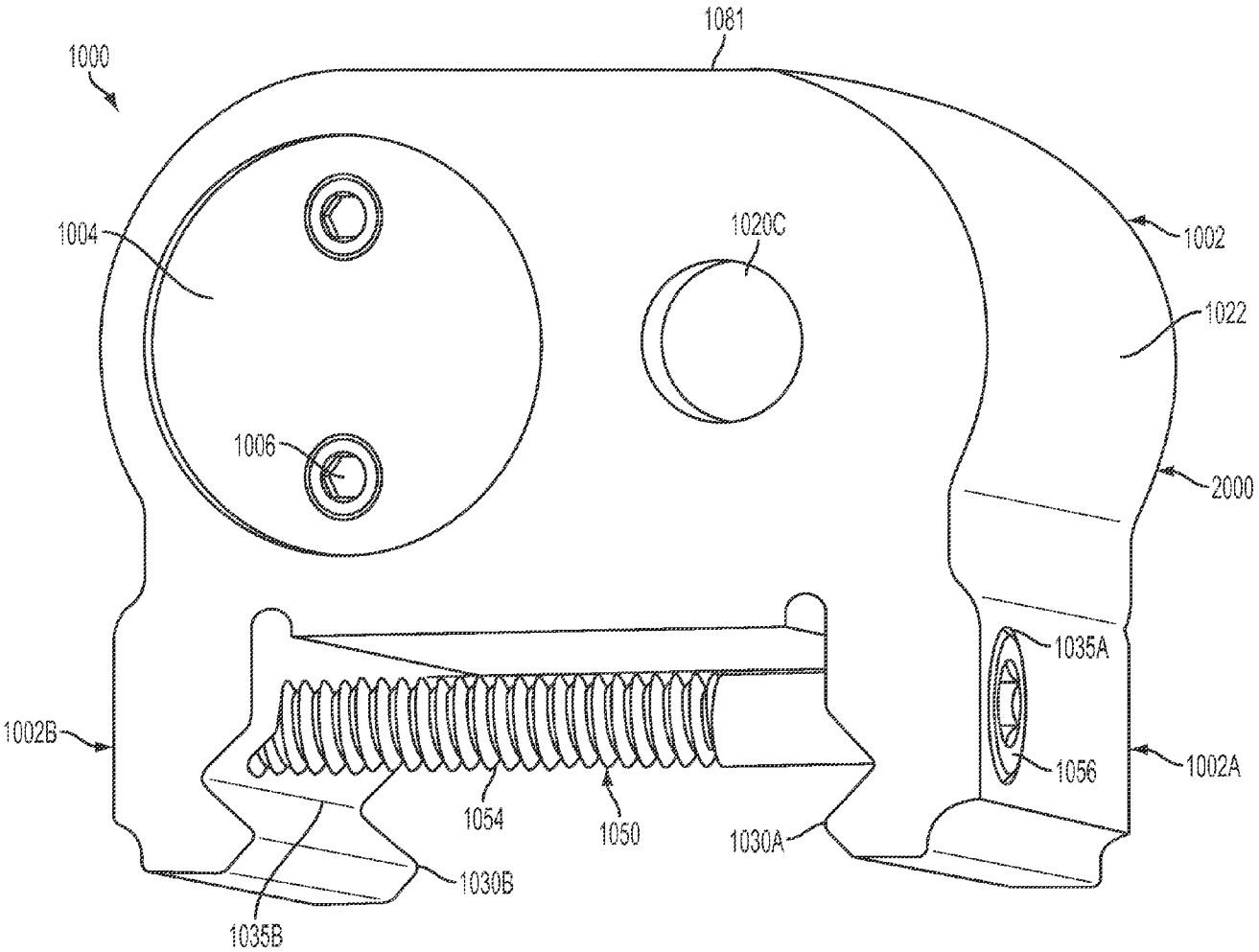
FIG. 8 shows an alternate embodiment of a sighting device of the present invention.
Figure 10:
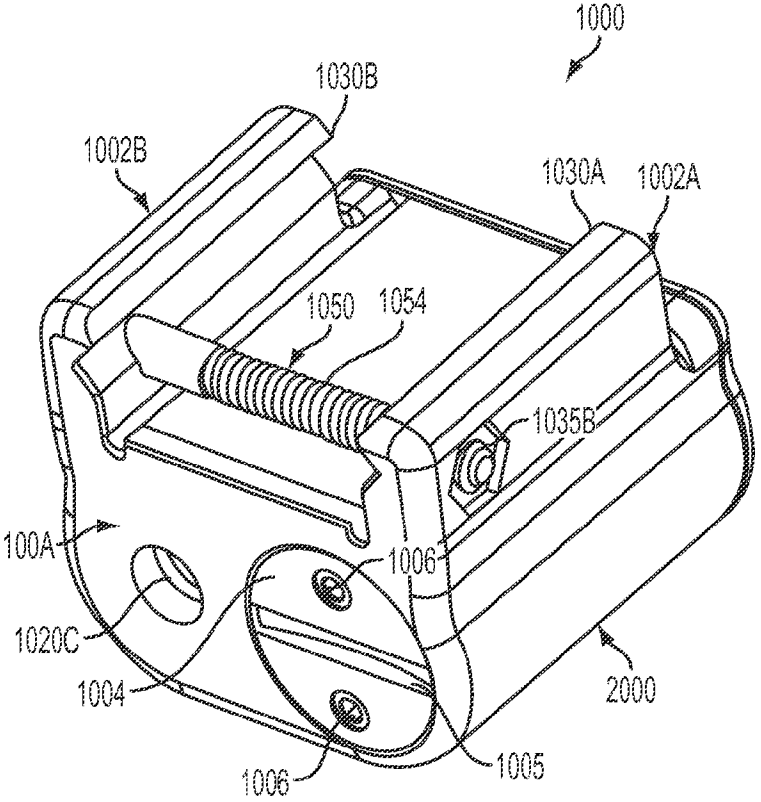
FIG. 10 shows a bottom, front perspective view of the sighting device of FIG. 8.
Figure 9:
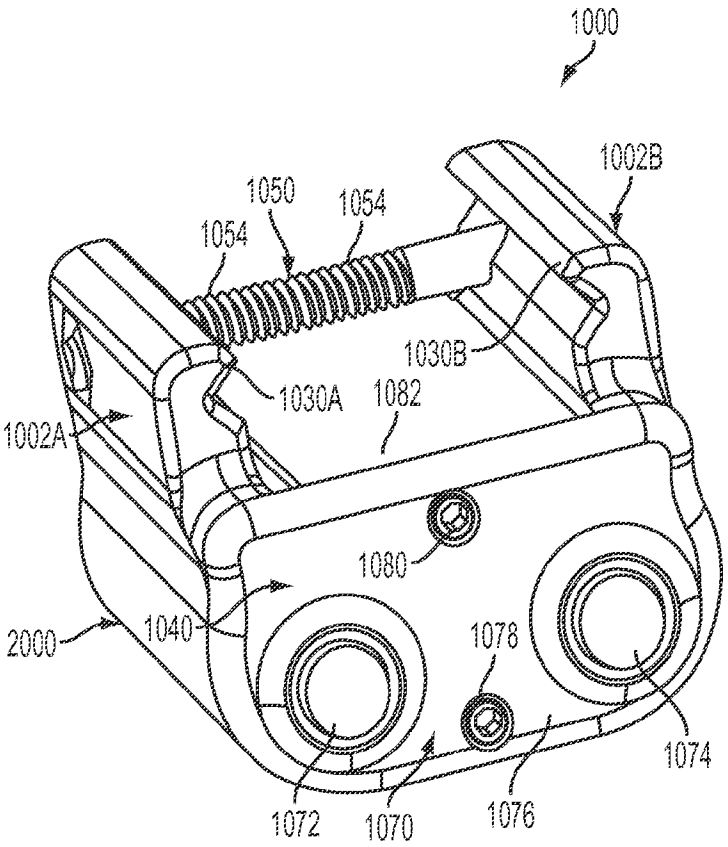
FIG. 9 shows a bottom, rear perspective view of the sighting device of FIG. 8.
Figure 11:
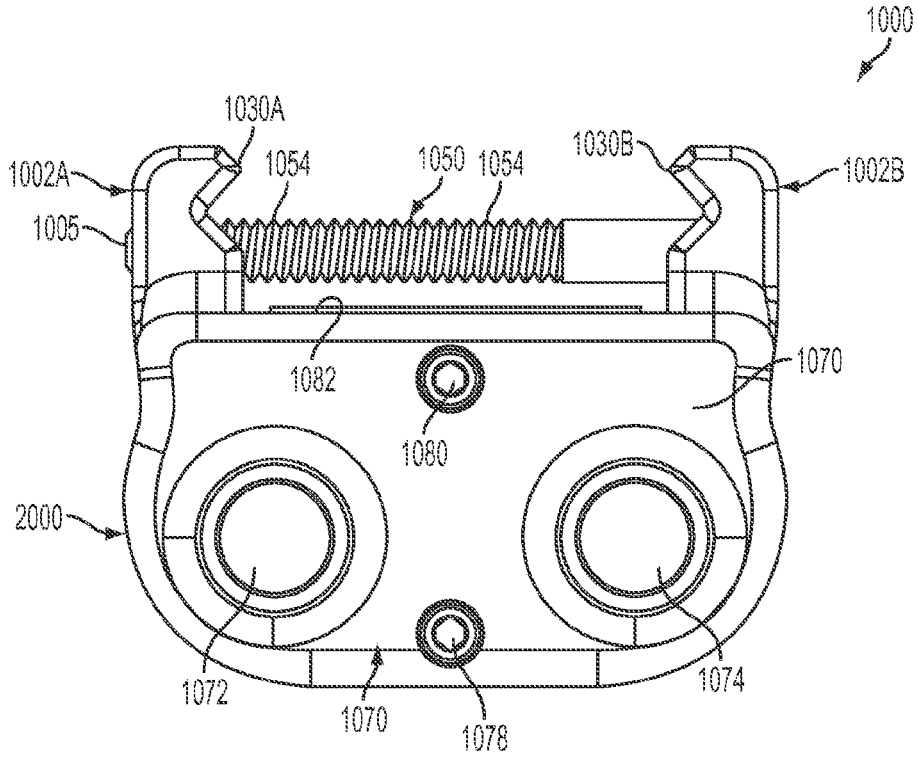
FIG. 11 shows a rear view of the sighting device of FIG. 8.
Figure 12:
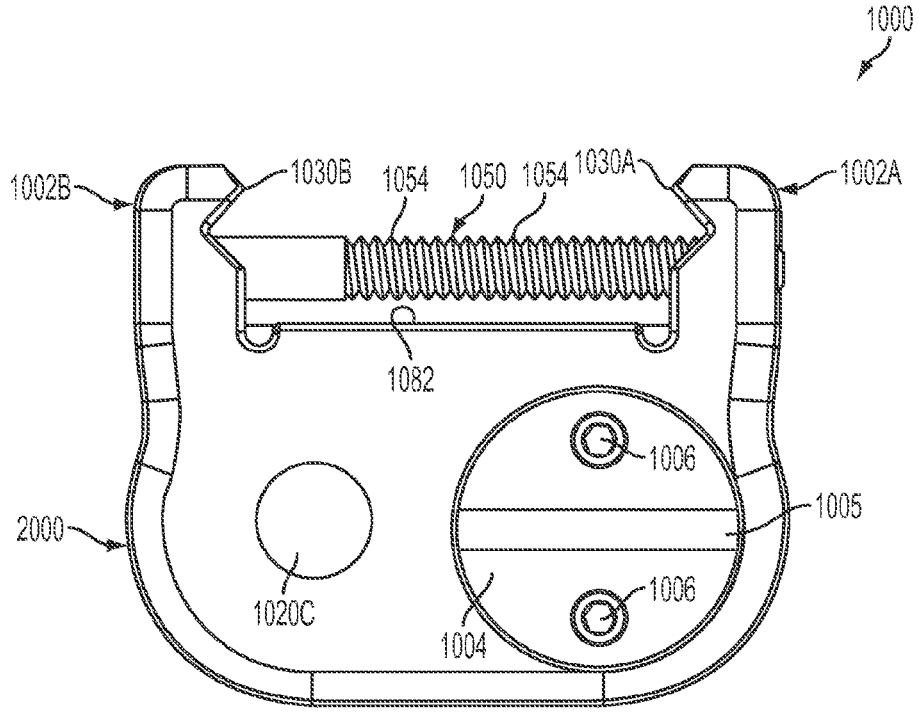
FIG. 12 shows a front view of the sighting device of FIG. 8.

The diffraction lens directs each of the multiple beams of light outward with respect to the longitudinal axis of the light source 20, as shown in FIG. 7. In one embodiment each of the multiple beams is directed outward at 1.7 degrees as measured from the longitudinal axis of the laser 20. Any suitable outward direction may be used, however, and is based on the size and type of shotgun, so that the pattern of pellet spread for that shotgun is accurately replicated.

The diffraction lens may also create one or more other light beams inside the area, and preferably creates a single light beam in the center of the area formed by the multiple beams.

Power source 30 can be any suitable power source for light source 20, and is preferably an electric power source and most preferably a portable, electrical power source such as a battery or multiple batteries. The embodiment shown uses four 1.5V silver oxide LR626 batteries 32, although any suitable batteries or other power source may be used.

Device 10 as shown further includes a housing 200, a light source adjustment apparatus 300, an integrated circuit board 400, a backing 500, and a battery cap 600. The purpose of housing 200 is to retain light source 20 and power source 30 and mount them to a gun, and to selectively connect power source 30 to light source 20. Any suitable structure or structures may be used for this purpose.

Housing 200 is preferably made of metal injection molded stainless steel (MIM), but could be made of any suitable material, such as another metal (for example, MIM carbon steel or extruded aluminum) or plastic. Housing 200 has a first end 200A, a second end 200B and includes a first canister 202 and a second canister 230. First canister 202 is configured to receive and retain the light source 20 (which is preferably a laser module), which as shown is first positioned in light source adjustment apparatus 300. Once so positioned, apparatus 300, with light source 20 inside, is positioned in and retained in canister 202.

As shown, canister 202 has an outer surface 204, a first rib 206, a second rib 208, an inner cavity 210 in which apparatus 300 and light source 20 are retained, and an opening 212 through which the light source 20 can emit light. Canister 202 also includes an aperture 206A that extends through rib 206 to inner cavity 210 and an aperture 208A that extends through rib 208 to inner cavity 210. Each of apertures 206A and 208A are configured to receive a moveable screw or screw 225 (hereafter referred to as "set screw" or "set screws," which are preferably socket-head set screws). The purpose of rib 206 and rib 208 (each of which project outward about 0.075") are to provide additional area to support set screws 225. Alternatively, a raised portion (described, for example with respect to device 10', device 1000 and device 2000) may be used in place of rib 206 and/or 208. Other structures may be used for this purpose or no such structure may be used.

Second canister 230 as shown is spaced apart from first canister 202 and is configured to receive and retain the power source 30. Canister 230 as shown has an outer surface 234, an inner cavity 240, a first end 242 and a second end 244. Second end 244 is configured to open in order to add or change power source 30. In the embodiment shown second end 244 includes internal threads (not shown) that mate with threads on power source retention cap 600 to allow cap 600 to be screwed onto end 244 and screwed off of end 244 in order to add or remove power source 30 from canister 230.

Housing 200 also includes a connective portion 270 that connects first canister 202 and second canister 230. Connective portion 270 has a bottom surface 272 and a mount 102 attached to or integrally formed with bottom surface 272. Mount 102 includes the previously described first leg and second leg (not shown here) for connecting to picatinny rail 9, although any suitable structure or structures may be used for this purpose.

A light source adjustment apparatus (or "LSAA") 300 is for retaining the light source 20 when it is positioned in housing 200 and for assisting in positioning light source 20. LSAA 300 serves two purposes: (1) it absorbs the recoil of a gun to which device 10 is mounted thereby enabling light source 20 to remain in a relatively stable position, and (2) it enables a user to adjust the position of light source 20. As shown in FIG. 1, LSAA 300 is generally conical with a first, smaller diameter end 302 and a second, large diameter end 304. It is preferably comprised of an elastomeric material, such as neoprene rubber, of about a 60 Shore A to absorb shock, but can be made of any suitable material. It has an opening 308 configured to receive light source 20. As previously described, LSAA 300 fits into inner cavity 210 of first canister 202. Instead of LSAA 300, the light source 20 may be biased towards set screws 225 (described below) by springs (not shown).

When device 10 is assembled, the position of light source 20 can be adjusted utilizing set screws 225. LSAA 300 is shaped to be biased towards apertures 206A and 208A and, as one or both set screws 225 are tightened, the set screw(s) pushes against LSAA 300 and moves it (in this embodiment) either sideways and/or vertically thereby adjusting the position of light source 20. Alternatively, springs inside cavity 210 bias the light source 20 towards each of the set screws 225, and as the set screws are tightened, they push against the light source 20 and overcome the force of the springs to move light source 20.

Integrated circuit board 400 is configured to be received and mounted on second end 200B of housing 200. The basic purpose of board 400 is to connect the power source 30 to the light source 20 and any suitable structure or device can be used for this purpose. Board 400 is preferably plastic and includes a push button switch 402, an integrated circuit 404 and two through screw holes 406. Current is transferred via board 400 to laser module 20. Board 400 is designed for negative switching wherein power is generated from the negative side of power source 30 (which are batteries in this embodiment) and through spring 24 of light source 20 in this embodiment. Integrated circuit 404 allows for the pulsed delivery of power to light source 20 (preferably about 1,000 cycles per second, and preferably pulsing at a 50% on duty rate) in order to save power and power source life, although the delivery of power need not be pulsed, or can be pulsed in any suitable manner. In this embodiment, the light source has between a 8 and 15 milliamp draw, and most preferably less than a 10 milliamp draw, of current when in use and utilizing the 1,000 pulses per minute delivery of current to light source 20.

A button 450 is of any suitable shape to fit with push button switch 402 and backing 500, described below. Button 450 is for enabling a user to selectively activate switch 402 thus turning the light source 20 off and on, and any suitable device or structure can be used for this purpose.

Backing 500 is preferably plastic and its purpose is to hold integrated circuit board 400 to housing 200 and to protect integrated circuit board 400 and the other components inside of housing 200. Backing 500 has a first side 500A configured to fit over canister 202 at end 200B and a second side 500B configured to fit over end 242 of canister 230. It further includes an opening 502 through which button 450 projects so it can be pressed by a user to turn light source 20 on and off, and openings 506 that align with screw holes 406 and screw retainers 250. Screws 510 are then received through openings 506 and screw holes 406, and are threaded into retainers 250 to hold device 10 together.

Power source retention cap 600 has a threaded end 602 and an end 604 that can be tightened or loosened by a user. The purpose of cap 600 is to selectively open and close second canister 230 to allow power source 30 to be removed or inserted and any structure capable of performing this function can be used. Cap 600 has a cavity 606 that receives a spring 608 to bias batteries 32 away from spring 608. Spring 608 contacts the positive side of the power source 30 and grounds it to the housing 200 through cap 600. As explained below, a rubber biasing collar 620 may also be utilized with cap 600.

Turning now to FIGS. 8-12, a device 1000 according to an aspect of the invention is shown. The materials, internal structure and function, except for differences in size and shape, and those described herein, are the same as those described for device 10. Device 1000 includes a housing 1002 that retains a light source 1020 (which is preferably a laser), which is the same as light source 20, and preferably a diffraction lens, which is the same as the previously described diffraction lens for device 10. The diffraction lens may be formed as part of light source 1020 or positioned outside of it so that a beam of light exiting light source 1020 is diffracted into multiple beams in the manner previously described and/or subsequently claimed herein. Alternatively, the multiple beams can be created in other ways.

An opening 1022 retains a set screw (not shown) that can be used to adjust the position of sighting device 1020 in the sideways direction. Another opening (not shown) is on the top surface 1081 of housing 1002 and retains another set screw (not shown), which can also be used to adjust the position of sighting device 1020 vertically.

A power source 1090 is retained within housing 1002 and is preferably three silver oxide 1.5V coin batteries connectable to light source 1020 in the same manner as previously described with respect to sighting device 10. Housing 1002 includes a removable cap 1004 that covers a cavity that retains the power source. Cap 1004 is held in place by two fasteners 1006.

Housing 1002 includes a first leg 1002A and a second leg 1002B, that are used to grip a picatinny rail, such as rail 9 shown in FIG. 7. First leg 1002A has a mating portion 1030A and an opening 1035A, and second leg 1002B has a mating portion 1030B and an opening 1035B. A fastener 1050 is positioned between first leg 1002A and second leg 1002B. First end 1056 of fastener 1050 is adapted for receiving the fastener 1050 and is retained in opening 1035A. Fastener 1050 has a threaded body 1054 that is threadingly received in opening 1035B, preferably by being threadingly received in a nut 1038 that is retained in opening 1035B. As fastener 1050 is tightened, it draws together mating portions 1030A and 1030B to tighten them against a picatinny rail. Fastener 1050 can then be loosened to remove device 1000 from the picatinny rail.

Turning now to FIGS. 9-13, the back surface 1040 of device 1000 includes two fasteners, 1078 and 1080, which as shown are hex head nuts with washers that are received in opening 1090 of circuit board 4000.

Light source 1020 has a first end 1020A (through which light can be emitted), is preferably a visible-light laser module, but could be any light source, including a light emitting diode ("LED") flashlight (as used herein "flashlight" means any source of visible light other than a laser) or an infra-red light source (such as an infra-red LED or infra-red laser). In the embodiment shown light source 1020 is a red-light, 650 nanometer or 635 nanometer, 3.3 mm diode, visible laser, and the laser module has an overall length of about 14 mm and a diameter of about 4.5 mm. Any suitable laser/laser module may be used, however. A biasing spring 24 is attached to second end 1020B to bias light source 1020 towards first end 1020A when device 1000 is assembled. Light source 1020 preferably includes a diffraction lens (not shown) that converts the single laser beam generated by light source 1020 into multiple, individual beams of light. In embodiments of the present invention, the diffraction lens can be assembled as part of light source 1020 or be positioned outside of light source 1020.

As with device 10, the multiple light beams generated by device 1000 are spread apart so as to define an area between the light beams. The area can be of any suitable shape for replicating the area in which pellets exiting a shotgun would occupy. It is most preferable that the area defined by the multiple light beams is circular, but it could also be triangular, oval, rectangular, hexagonal, octagonal or of any suitable shape. In one preferred embodiment there are at least three light beams defining the area, and most preferably eight beams of light defining the area, even though any number of light beams of three or more can be utilized.

The diffraction lens, or other method of generating multiple light beams, s directs each of the multiple beams of light outward with respect to the longitudinal axis of the light source 1020. In one embodiment each of the multiple beams is directed outward at 1.7 degrees as measured from the longitudinal axis of the laser 20. Any suitable outward direction may be used, however, and is based on the size and type of shotgun, so that the pattern of pellet spread for that shotgun is accurately replicated.

The light source may also create one or more other light beams inside the area, and preferably creates a single light beam in the center of the area formed by the multiple beams.

Power source 1090 can be any suitable power source for light source 1020, and is preferably an electric power source and most preferably a portable, electrical power source such as a battery or multiple batteries. The embodiment shown uses 3 silver oxide 1.5V silver oxide coin batteries, although any suitable batteries or power source may be used.

Device 1000 as shown further includes a housing 2000, a light source adjustment apparatus 3000, an integrated circuit board 4000, a canister 5000 having a first cavity 5002, a second opening 5004, a first end 5006, a second end 5008, and a dividing wall 5010. First cavity 5002 retains light source 1020 and light source adjustment apparatus ("LSAA") 3000, wherein light source adjustment apparatus 3000 is first positioned over light source 1020 prior to being positioned in first canister 5002. Second cavity 5004 retains power source 1090. The ultimate purpose of housing 2000 is to retain light source 1020 and power source 1090 and mount them to a gun, and to selectively connect power source 1090 to light source 1020. Any suitable structure or structures may be used for this purpose.

Housing 2000 is preferably made of injection molded plastic, but could be made of any suitable material, such as another metal (for example, MIM carbon steel or extruded aluminum). Housing 2000 has a first end 2000A, a second end 2000B and includes a cavity 2001 that retains canister 5000. Canister 5000 is preferably made of aluminum or other conductive material so as to complete the connectivity required for the proper functioning of the circuit board 4000, when circuit board 4000 is pressed against end 5008 of canister 5000 when device 1000 is fully assembled.

Housing 2000 has a first end 2000A with an opening 1020C to permit light to be emitted from light source 1020 (preferably through a diffraction lens), and an opening 2001A that retains cap 1004 and permits access to the power source 1090 to permit replacement of the power source.

As discussed above, housing 2000 also includes an aperture 1022 that extends to either LSAA 3000 or light source 1020. A second aperture (not shown) on surface 1081 also extends to either LSAA 3000 or light source 1020. Each of these apertures are configured to receive a moveable screw (hereafter referred to as "set screw" or "set screws," which are preferably socket-head set screws), which are not shown for this embodiment.

An opening 5004A in the first end of canister 5004 is preferably threaded (not shown) so that it can receive cap 1004, which is threaded. A depression 1005 is formed in cap 1004 in order to screw cap 1004 onto end 5004A. Cap 1004 can be removed to access and replace power source 1090.

Figure 13:
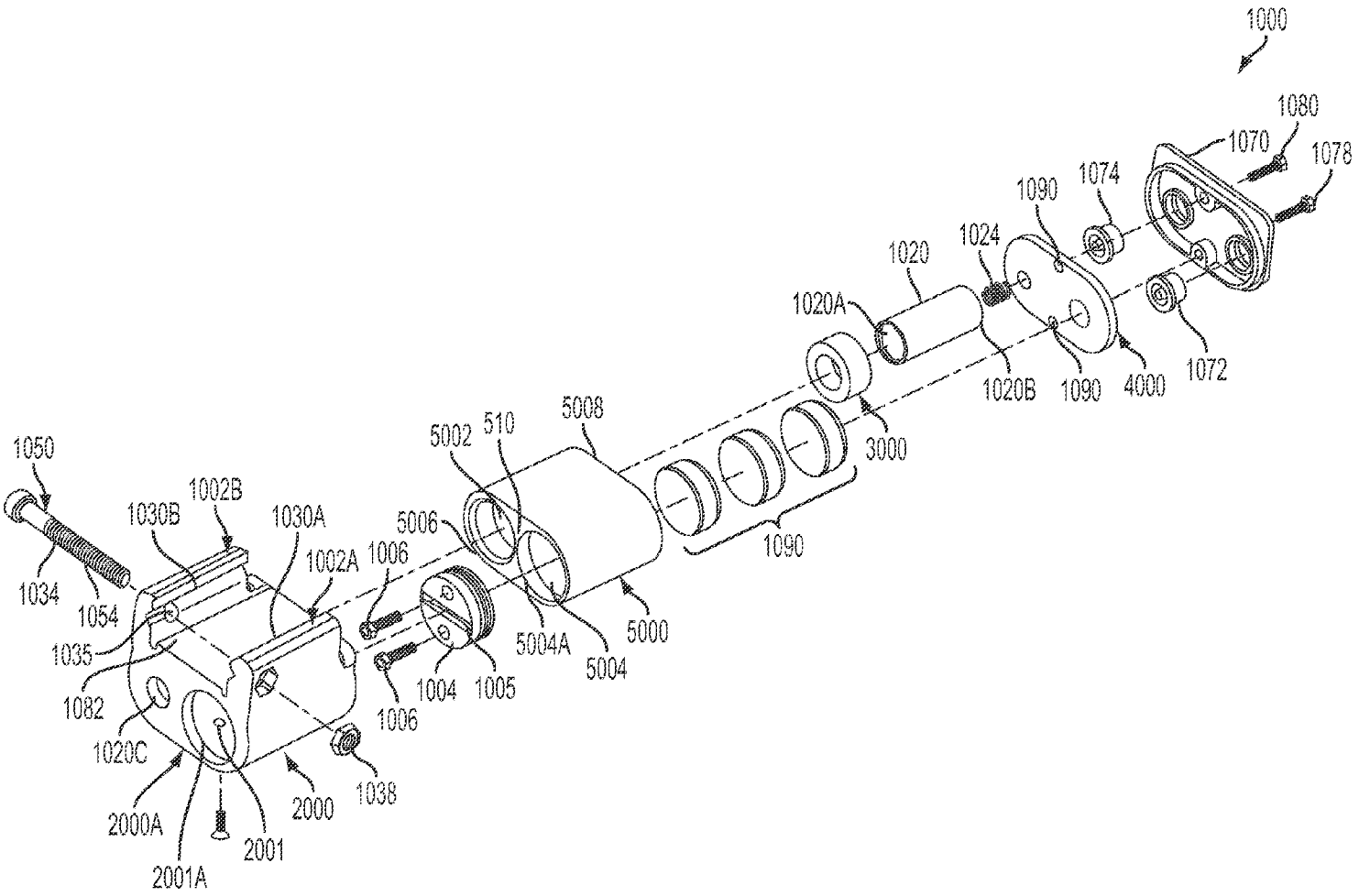
FIG. 13 shows an exploded view of the sighting device of FIG. 8.

A light source adjustment apparatus (or "LSAA") 3000 is for retaining the light source 1020 when it is positioned in canister 5000 and for assisting in positioning light source 1020. LSAA 3000 absorbs the recoil of a gun to which device 1000 is mounted thereby enabling light source 1020 to remain in a relatively stable position. As shown in FIG. 13, LSAA 3000 may be generally conical and slides over light source 1020. It is preferably comprised of an elastomeric material, such as neoprene rubber, of about a 60 Shore A to absorb shock, but can be made of any suitable material. As previously described, LSAA 3000 fits into cavity 5002 of canister 5000. Instead of LSAA 3000, or in addition to LSAA 3000, the light source 20 may be biased towards the set screws (not shown in this embodiment) by springs (not shown).

When device 1000 is assembled, the position of light source 1020 can be adjusted utilizing the set screws (not shown). LSAA 3000 and/or the springs (not shown) can bias the light source 1020 towards the set screws. As one or both of the set screws are tightened, the set screw(s) pushes against the LSAA 3000 or the light source 1020 and moves the light source 1020 either sideways and/or vertically thereby adjusting the position of light source 1020.

Integrated circuit board 4000 is configured to be received and mounted on plate 1070 of housing 2000. The basic purpose of board 4000 is to connect the power source 1090 to the light source 1020 and any suitable structure or device can be used for this purpose. Board 4000 is preferably plastic and interacts with two push button switches 1072 and 1074. Board 4000 includes an integrated circuit (not shown) and two through screw holes 1090. Current is transferred via board 4000 to laser module 1020. Board 4000 is designed for negative switching wherein power is generated from the negative side of power source 1090 (which are batteries in this embodiment) and through spring 1024 of light source 1020 in this embodiment. In the preferred embodiment of device 1000, the integrated circuit allows for continuous delivery of power to light source 1020.

In this embodiment, spring 1024 is connected to the back of laser module 1020 in any suitable manner, and is then connected to board 4000, preferably by soldering. Spring 1024 acts as the negative contact for module 1020 to board 4000 and also allows module 1020 to move freely back and forth axially and in all directions. In this manner, module 1020 can freely be adjusted by the previously described set screws.

Buttons 1072 and 1074 are preferably identical and of any suitable shape to fit in the openings in plate 1070 and switch power off or on to light source 1020. Each button 1072 and 1074 operates independently and is for enabling a user to selectively activate a switch to turn the light source 1020 off or on, and any suitable device or structure can be used for this purpose.

Device 1000 also preferably includes a backing, such as backing 5000, which is preferably plastic. Although not shown here, the backing is of a suitable size, shape and material to function the same as previously described backing 500.

A sighting device according to the invention may be mounted to a shotgun in any suitable manner utilizing any suitable structure.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A gun including:

(a) a muzzle, (b) a bore, (c) a trigger, and (d) a sighting device for framing a target to be fired at with the gun, the sighting device including a first light source that is a single laser module and a power source connectable to the first light source, the first light source having a first mode in which it emits light and a second mode in which it does not emit light, the first light source emanating a single beam of light that passes through a diffraction lens which splits the single beam into a pattern of three or more light beams defining an area inside the pattern and a separate beam of light inside the pattern, wherein the area of the pattern increases as the beams of light move farther from the first light source.

2. The gun of claim 1 that is a shotgun.

3. The gun of claim 2 wherein the sighting device includes a mount for attaching to a picatinny rail of the shotgun.

4. The gun of claim 3 wherein the mount includes a first leg configured to fit into a first side of the picatinny rail and a second leg opposite the first leg, the second leg configured to fit into a second side of the picatinny rail.

5. The gun of claim 4 that further includes a tightener to draw the first leg and second leg closer together in order to tighten the mount onto the picatinny rail.

6. The gun of claim 5 wherein the tightener comprises a threaded fastener that extends from the first leg to the second leg, the fastener having a head at the first leg for receiving a tool, and being threadingly received in the second leg, so as the tool turns the fastener head in a first direction, the fastener is tightened in the second leg, which forces the first leg and second leg closer together, and as the tool turns the fastener in a second direction, the fastener is loosened in the second leg and the first leg and second leg move farther apart.

7. The gun of claim 2 wherein the muzzle has a longitudinal axis, and the sighting device is aligned with the longitudinal axis so the light emanating from the sighting device projects a pattern that replicates the pattern of shotgun pellets exiting the muzzle of the shotgun.

8. The gun of claim 1 wherein the single beam of light passes through the diffraction lens which splits the single beam into eight beams of light and the area is in the center of the eight beams of light, wherein the area of the pattern increases as the beams of light move farther from the first light source.

9. The gun of claim 8 wherein the diffraction lens splits the single beam into a pattern of eight or more light beams defining an area inside the pattern and a separate beam of light in the center of the area, wherein the area of the pattern increases as the beams of light move farther from the first light source.

10. The gun of claim 1 wherein the light beams exit the diffraction lens at an outward angle of 1.7 degrees as measured from a longitudinal axis of the first light source.

11. The gun of claim 1 wherein the first light source is a visible laser module.

12. The gun of claim 1 wherein the first light source is an infra-red laser module.

13. The gun of claim 1 that further includes a light source adjustment apparatus for mechanically adjusting the position of the first light source, wherein the light source adjustment apparatus comprises one or more set screws and springs that bias the first light source towards each set screw.

14. The gun of claim 13 wherein the first light source further includes a housing with a plurality of apertures and a set screw threadingly received in each aperture, the set screws for adjusting the position of the first light source.

15. The gun of claim 1 wherein the first light source is a LED infra-red light module.

16. The gun of claim 1 wherein the power source is one or more batteries.

17. The gun of claim 1 wherein the power source is spaced apart from the first light source.

18. The gun of claim 1 wherein the power source is positioned under the first light source.

19. The gun of claim 1 wherein the sighting device includes a mount that may be pressure fit into a slot on the gun.

20. The gun of claim 1 wherein the sighting device includes a mount for attaching to a picatinny rail of the gun.

21. The gun of claim 1 wherein the sighting device includes a first canister and a second canister, wherein the first canister includes the first light source, and the second canister includes the power source.

22. The gun of claim 1 wherein the first light source pulses when it emits light.

23. The gun of claim 1 wherein the area is selected from one of the group consisting of: circular, oval, triangular, rectangular, hexagonal and octagonal.

24. The gun of claim 1 wherein the sighting device is mounted on the gun.

25. The gun of claim 1 wherein the sighting device is integrally formed with the gun.

* * * * *